US008098841B2

(12) United States Patent
Sawara et al.

(10) Patent No.: US 8,098,841 B2
(45) Date of Patent: Jan. 17, 2012

(54) SOUND FIELD CONTROLLING APPARATUS

(75) Inventors: Shinichi Sawara, Kosai (JP); Akira Miki, Hamamatsu (JP); Atsuko Ito, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1161 days.

(21) Appl. No.: 11/522,068

(22) Filed: Sep. 14, 2006

(65) Prior Publication Data

US 2007/0058820 A1 Mar. 15, 2007

(30) Foreign Application Priority Data

Sep. 14, 2005 (JP) ..... 2005-267181

(51) Int. Cl.
*H04R 27/00* (2006.01)
*H04R 15/00* (2006.01)

(52) U.S. Cl. ..... 381/83; 381/93

(58) Field of Classification Search ..... 381/82, 381/77, 79, 80, 387, 83, 94.1, 94.9, 104, 381/93, 96; 379/406.07, 406.11
See application file for complete search history.

(56) References Cited

U.S. PATENT DOCUMENTS

| | | | | |
|---|---|---|---|---|
| 4,275,269 | A * | 6/1981 | Sugita et al. | 381/82 |
| 5,642,425 | A * | 6/1997 | Kawakami | 381/63 |
| 6,862,541 | B2 * | 3/2005 | Mizushima | 702/76 |
| 6,888,058 | B2 * | 5/2005 | Urai et al. | 84/737 |
| 7,130,430 | B2 * | 10/2006 | Milsap | 381/77 |
| 7,492,913 | B2 * | 2/2009 | Connor et al. | 381/77 |
| 7,716,044 | B2 * | 5/2010 | Kobayashi et al. | 704/205 |

FOREIGN PATENT DOCUMENTS

| | | |
|---|---|---|
| JP | 7-336790 | * 12/1995 |
| JP | 09-247787 | 9/1997 |

* cited by examiner

*Primary Examiner* — Hai Phan
(74) *Attorney, Agent, or Firm* — Morrison & Foerster LLP

(57) ABSTRACT

A sound field controlling apparatus for a public-address system comprises a microphone that picks up a sound of a speaker, a loudspeaker that sound a sound signal based on the sound picked up by the microphone, a sound source position detector that detects a position of a sound source, and a signal processor that controls a level, delay time and equalizing property of the sound signal output to the loudspeaker in accordance with the sound source position detected by the sound source position detector.

3 Claims, 6 Drawing Sheets

SOUND FIELD CONTROLLING APPARATUS

CROSS REFERENCE TO RELATED APPLICATION

This application is based on Japanese Patent Application 2005-267181, filed on Sep. 14, 2005, the entire contents of which are incorporated herein by reference.

BACKGROUND OF THE INVENTION

A) Field of the Invention

This invention relates to a sound field controlling apparatus used in a public-address system.

B) Description of the Related Art

A public-address system is necessary when a speaker and an audience are in the same room and the audience cannot hear sufficiently what the speaker says because the room is large to some extent.

FIG. 5 shows an example of a structure of a conventional public-address system. In the example shown in the drawing, a microphone 71 and a plurality of loudspeakers $\mathbf{80}_0$-$\mathbf{80}_n$ are equipped in a hall or meeting room 70, and a voice picked up by the microphone 71 is reinforced so that the audience can hear the voice from the loudspeakers $\mathbf{80}_0$-$\mathbf{80}_n$. At this time, acoustic feedbacks with loop properties $H_0$-$H_n$ exist.

A voice signal obtained by the microphone 71 is amplified by a head amplifier 72, converted to a digital signal by an A/D converter 73 and input to a digital signal processor (DSP) 74. The DSP 74 executes functions such as equalizing, controlling a delay time given to an input signal, controlling a level of an input signal, etc. After passing through an equalizer 75, the input digital signal is distributed to a plurality (n+1) of output lines, each corresponding to the plurality of loudspeakers $\mathbf{80}_0$-$\mathbf{80}_n$. Thereafter, the distributed signals are respectively processed by equalizers $\mathbf{76}_0$-$\mathbf{76}_n$, delay time and level controllers $\mathbf{77}_0$-$\mathbf{77}_n$, each of which are dedicated to each one of output lines, and then output to the loudspeakers $\mathbf{80}_0$-$\mathbf{80}_n$ via D/A converters $\mathbf{78}_0$-$\mathbf{78}_n$ and power amplifiers $\mathbf{79}_0$-$\mathbf{79}_n$.

The equalizer 75 and the equalizers $\mathbf{76}_0$-$\mathbf{76}_n$ compensate the loop property. The equalizer 75 controls the loop property (acoustic feedback property) that is common to all of the output lines, and each of the equalizers $\mathbf{76}_0$-$\mathbf{76}_n$ that are equipped in correspondence to the output lines respectively controls a loop property to the microphone 71 from corresponding one of the loudspeakers $\mathbf{80}_0$-$\mathbf{80}_n$. Besides, the loudspeakers $\mathbf{80}_0$-$\mathbf{80}_n$ can be omitted.

The delay time and level controllers $\mathbf{77}_0$-$\mathbf{77}_n$ control delay times given to reinforced signals sounded form the loudspeakers $\mathbf{80}_0$-$\mathbf{80}_n$ and control the volume levels of the reinforced signals. The delay times corresponding to distances from a position of the microphone 71 (a source position) are given to the reinforced signals sounded form the loudspeakers $\mathbf{80}_0$-$\mathbf{80}_n$ so that the audience can hear a direct sound from the speaker and the sound from the loudspeakers $\mathbf{80}_0$-$\mathbf{80}_n$ at the same timing, and the levels of the reinforced signals sounded form the loudspeakers $\mathbf{80}_0$-$\mathbf{80}_n$ not to generate a howling by the acoustic feedback.

Further, in the publication of Japanese Laid-open Patent H09-247787, a sound field controlling apparatus for restraining a howling by optimizing a system structure automatically or manually in a public-address system having a plurality of microphones and a plurality of loudspeakers. The sound field controlling apparatus comprises means for measuring a transfer function between each microphone and each loudspeaker, calculates information such as howling margin and a frequency response necessary for system architecture for each combination of the microphone and the loudspeaker by using the measured transfer function. Thereafter, the calculated information is output to provide it to an operator or used for modifying a mixing setting and amplification rate automatically.

In the above-described conventional public-address system, a position of the microphone for picking up sound is fixed, and an input from the microphone of which position is fixed is sounded from one or plurality of loudspeakers after adjusting a delay time and loop property.

In this case, there is no problem if the microphone is at a predetermined position (addressing position). However, when the speaker moves with using a wireless microphone so that the position of the speaker changes to some extent, loop properties $H_0$-$H_n$ to the microphone changes largely, and it makes howling unstable and affects to a sound quality.

SUMMARY OF THE INVENTION

It is an object of the present invention to provide a sound field controlling apparatus that is stable against howling and can executes high-quality public-address by improving clarity and quality of reinforced sound even if a speaker moves.

According to one aspect of the present invention, there is provided a sound field controlling apparatus for a public-address system, the sound field controlling apparatus comprising: a microphone that picks up a sound of a speaker; a loudspeaker that sounds a sound signal based on the sound picked up by the microphone; a sound source position detector that detects a position of a sound source; and a signal processor that controls a level, delay time and equalizing property of the sound signal output to the loudspeaker in accordance with the sound source position detected by the sound source position detector.

According to the present invention, it can be possible to detect a position of a speaker and control a delay time, level and equalizing property of a signal output to a loudspeaker for optimized delay time, volume and loop property (a transfer property between each loudspeaker and a microphone) in accordance with change in the position of the speaker. Therefore, generation of howling can be avoided, and at the same time, a high quality reinforced sound can be provided to an audience by maintaining high clarity and necessary sound pressure level.

Moreover, according to the present invention, a clear reinforced sound can be obtained by convolving a reflected sound within a predetermined time by an FIR tap that does not loss a phase property.

Furthermore, according to the present invention, it is possible to control various sound field processing devices such as a plurality of equalizers, etc. without a trained sound operator so that an optimized reinforced sound can be provided to an audience.

BRIEF DESCRIPTION OF THE DRAWINGS

FIG. 2A is a diagram for explaining a loop property measurement. FIG. 2B is a diagram showing an example of a loop property when a distance between a microphone and a loudspeaker is short. FIG. 2C is a diagram showing an example of a loop property when a distance between a microphone and a loudspeaker is middle. FIG. 2D is a diagram showing an example of a loop property when a distance between a microphone and a loudspeaker is long.

FIG. 4A is a plan view of a meeting room 10. FIG. 4B is a diagram showing an example of a time structure of an input signal to a microphone 11 when a source position is close to a loudspeaker. FIG. 4C is a diagram showing an example of a time structure of an input signal to a microphone 11 when a source position is far from a loudspeaker.

DETAILED DESCRIPTION OF THE PREFERRED EMBODIMENTS

Figure 1:
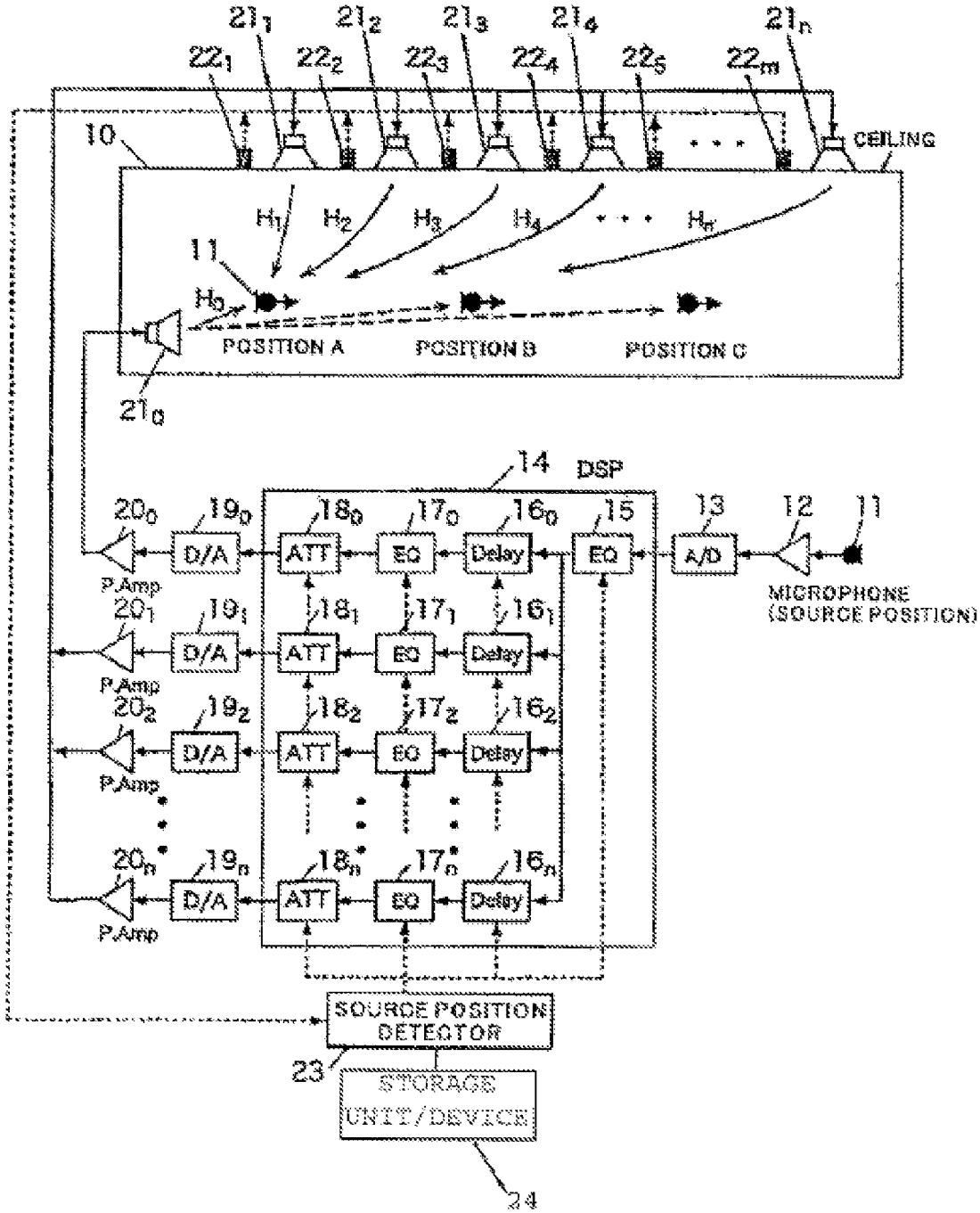
FIG. 1 is a block diagram showing a structure of a sound field controlling apparatus according to a first embodiment of the present invention.

FIG. 1 is a block diagram showing a structure of a sound field controlling apparatus according to a first embodiment of the present invention. In this drawing, a reference number "10" represents a hall or meeting room equipped with a public-address system applying the sound field controlling apparatus according to the first embodiment of the present invention, and a reference number "11" represents a microphone for picking up a voice of a speaker. Although the number of loudspeakers may be one or plural, this embodiment uses a plurality of loudspeakers $\mathbf{21}_0$-$\mathbf{21}_n$ on a front side (a left side in the drawing) and a ceiling of the meeting room 10, and the voice picked up by the microphone 11 is sounded from the loudspeakers $\mathbf{21}_0$-$\mathbf{21}_n$. Moreover, on the ceiling of the meeting room 10, a plurality of sensors $\mathbf{22}_1$-$\mathbf{22}_m$ for detecting a position of a sound source so that a position of the speaker (a source position) can be detected.

Besides, the source position detecting sensors $\mathbf{22}_1$-$\mathbf{22}_m$ may be any type of sensors that can detects a position of a speaker or a position of the microphone picking up a voice of a speaker. For example, the sensors $\mathbf{22}_1$-$\mathbf{22}_m$ may be a human detecting sensor using infrared light or ultrasonic, a sensor using global positioning system (GPS), a plurality of microphones arranged dispersively on a ceiling of the meeting room, etc.

When the plurality of microphones arranged dispersively on a ceiling are used as the source position detecting sensors $\mathbf{22}_1$-$\mathbf{22}_m$, the microphone $\mathbf{22}_1$ of which input level is the largest among the plurality of microphones having input levels larger than a predetermined level will be selected for the microphone 11 for picking up a voice of a speaker.

The voice signal picked up by the microphone 11 that picks up the voice of the speaker is input to an equalizer 15 via a head amplifier 12 and an A/D converter 13, and an output of the equalizer 15 is sequentially input to delay means $\mathbf{16}_o$-$\mathbf{16}_n$, equalizers $\mathbf{17}_o$-$\mathbf{17}_n$ and attenuators (ATT) $\mathbf{18}_o$-$\mathbf{18}_n$ respectively equipped in each line divided to plurality of output lines corresponding to the plurality of the loudspeakers $\mathbf{21}_o$-$\mathbf{21}_n$. Although the equalizer 15, the delay means $\mathbf{16}_o$-$\mathbf{16}_n$, equalizers $\mathbf{17}_o$-$\mathbf{17}_n$ and ATT $\mathbf{18}_o$-$\mathbf{18}_n$ may be realized by individual circuits, they are realized by a digital signal processing device (DSP) 14 in the embodiment of the present invention.

Thereafter, the position (source position) of the microphone 11 and the delay time corresponding to the distance between the each loudspeaker are added by the delay means $\mathbf{16}_o$-$\mathbf{16}_n$, and the loop property between the each speaker $\mathbf{21}_o$-$\mathbf{21}_l$ and the microphone 11 is controlled by the equalizer 15, the equalizers $\mathbf{17}_o$-$\mathbf{17}_n$ and the ATT $\mathbf{18}_o$-$\mathbf{18}_n$. Here, each equalizing (GEQ or PEQ) property is respectively controlled by the equalizers $\mathbf{17}_o$-$\mathbf{17}_n$, and the equalizing (GEQ or PEQ) property common to the all loops is controlled by the equalizer 15.

Controlling amount in the equalizer 15, the delay means $\mathbf{16}_o$-$\mathbf{16}_n$, the equalizers $\mathbf{17}_o$-$\mathbf{17}_n$ and the ATT $\mathbf{18}_o$-$\mathbf{18}_n$ is controlled by a control parameter provided from the source position detector 23 corresponding to the source position.

The source position detector 23 always (for example, at a predetermined period) detects the source position (the position of the speaker or the position of the microphone for picking up the voice of the speaker) based on the output of the source position detecting sensors $\mathbf{22}_l$-$\mathbf{22}_m$, and provides a new controlling parameter corresponding to the detected source position to the equalizer 15, the delay means $\mathbf{16}_o$-$\mathbf{16}_n$ of each output line, the equalizers $\mathbf{17}_o$-$\mathbf{17}_n$ and the ATT $\mathbf{18}_o$-$\mathbf{18}_n$ when a new source position or the movement of the source position is detected.

In a storage unit 24 connected with the source position detector 23, table storing a delay time, output level and the rising property set to the signals (signals output to each loudspeaker) of each output line are stored by each source position in advance. The source position detector 23 provides a new controlling parameter to the equalizer 15, the delay means $\mathbf{16}_o$-$\mathbf{16}_n$, the equalizers $\mathbf{17}_o$-$\mathbf{17}_n$ and the ATT $\mathbf{18}_p$-$\mathbf{18}_n$ to the signals of the each output line corresponding to the source position with reference to the table when a new source position or the movement of the source position is detected based on the output from the source position detecting sensors $\mathbf{22}_l$-$\mathbf{22}_m$.

Moreover, the above-described table does not need to store the each controlling parameter for the all of the source position, and may store the common controlling parameter for the source position within a fixed area (zone).

Moreover, when the source position is moved and the controlling parameter to be provided to the equalizer 15, the delay means $\mathbf{16}_o$-$\mathbf{16}_n$, equalizer $\mathbf{17}_o$-$\mathbf{17}_n$ and the ATT $\mathbf{18}_p$-$\mathbf{18}_n$ is changed, it is preferable to gradually change the controlling parameter in order not to generate noise such as sound disconnection, clicking sound and the like.

The signal of each output line added delay time, the output level and equalizing property corresponding to the detected source position is output from the DSP 14. Then, the signal is amplified by a power amplifier $\mathbf{20}_o$-$\mathbf{20}_n$ via the corresponding D/A converter $\mathbf{19}_o$-$\mathbf{19}_n$ and is output from each loudspeaker $\mathbf{21}_o$-$\mathbf{21}_n$.

As described in the above, when the speaker moves from a position A to a position B, from the position B to a position C, the audience can hear a direct sound from the speaker and the sound from the loudspeakers $\mathbf{21}_0$-$\mathbf{21}_n$ at the same timing. Also, generation of the howling can be prevented by controlling the loop property by the equalizer 15, the equalizers $\mathbf{17}_o$-$\mathbf{17}_n$ and the ATT $\mathbf{18}_o$-$\mathbf{18}_n$.

More in detail, delay time, level and equalizing property of the signal to be reinforced is set as described in the below. That is, delay time is set to reach the sound to the audience within a fixed time (40 msec) described later so that the audience can hear the direct sound from the speaker and the sound from the loudspeaker at the same timing. By setting as the above, clarity of the sound of the speaker can be improved. This delay time is in proportion with the distance between the speaker and the audience. Moreover, since sound image of the speakers is not controlled, delay time is not set to exceed the above-described predetermined time.

Next, it is an object to improve clarity of the sound of the speaker regarding to the levels. Reinforcement is not necessary at a position (near the speaker) maintaining a sufficient level. However, as the distance from the speaker becomes larger, the direct sound becomes smaller. Then, level of the reinforced sound is set to make up the direct sound. Moreover, since sound image of the speakers is not controlled, the levels of the reinforced sound are not limited in order to store the sound image of the speaker.

Setting of the equalizing property is explained in detail later. The reinforcement gain is raised, and the equalizing property is set so that a frequency response of the loop property (acoustic feedback property) between the each loudspeaker and the microphone is flattened or equalized.

Moreover, each output line may be equipped with switches (not shown in FIG. 1), and the loudspeaker to output the reinforced sound corresponding to the source position may be selected by controlling on/off corresponding to the source position detected the switch. For example, the reinforced sound may not be output from the loudspeaker near the speaker.

Moreover, in FIG. 1, an example that the number of the microphones 11 for picking up the voice is one; however, plurality of the microphones may be selected as the microphones for picking up the voice, and input signals of plural lines may be reinforced. In this case, input means that can select plurality of the microphones for picking up the voice is equipped, and the head amplifier 12, the A/D converter 13 and the DSP 14 processing the input signal from the selected each microphone are equipped by each input signal to convert to the digital signal by the D/A converters $\mathbf{19}_o$-$\mathbf{19}_n$ after adding the output signals. Then, the digital signals may be output from the power amplifiers $\mathbf{20}_o$-$\mathbf{20}_n$ to the speaker $\mathbf{21}_o$-$\mathbf{21}_n$.

Next, creation of the table stored in the storage device 24 is explained with reference to FIG. 2.

The loop property between the plurality of the loudspeakers by each source position is measured in advance to create the table storing the controlling parameter for setting delay time, the output level and the equalizing property set to the reinforced signal to each output line by each source position. Moreover, the loop property can be determined from a relationship among positions of the microphone and the loud speakers in advance. The controlling parameter for deciding the loop property of the output line corresponding to the plurality of the loudspeakers by each source position is determined based on the measured result.

Figure 2A:
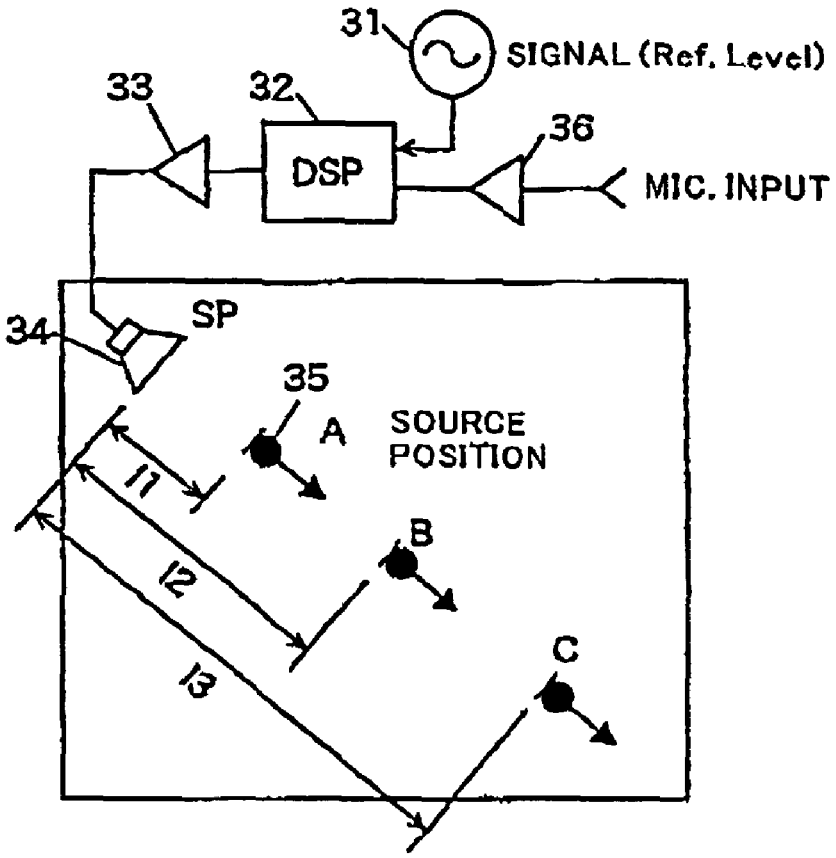
FIG. 2A to FIG. 2D are drawings for explaining creation of a table.

FIG. 2A is a diagram for explaining a loop property measurement.

In this drawing, a reference number "31" represents a signal generator, a reference number "32" represents a power amplifier, a reference number "34" represents a loudspeaker, a reference number "35" represents a microphone, and a reference number "36" represents a head amplifier. The microphones 35 are set at plural positions (A, B and C) which have different distances from the loudspeaker 34, a basic signal from the signal generator 31 is output from the loudspeaker 34 to measure the amount of acoustic feedback to the microphone 35 for picking up the voice.

Figure 2B:
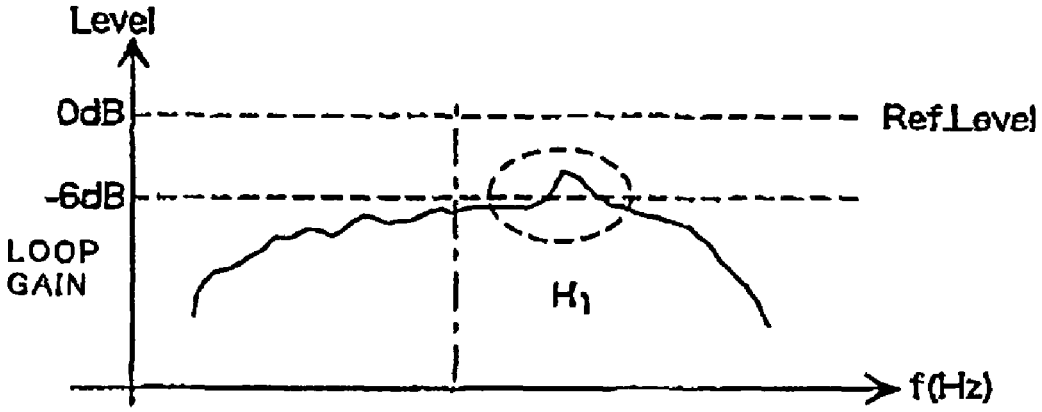
Figure 2C:
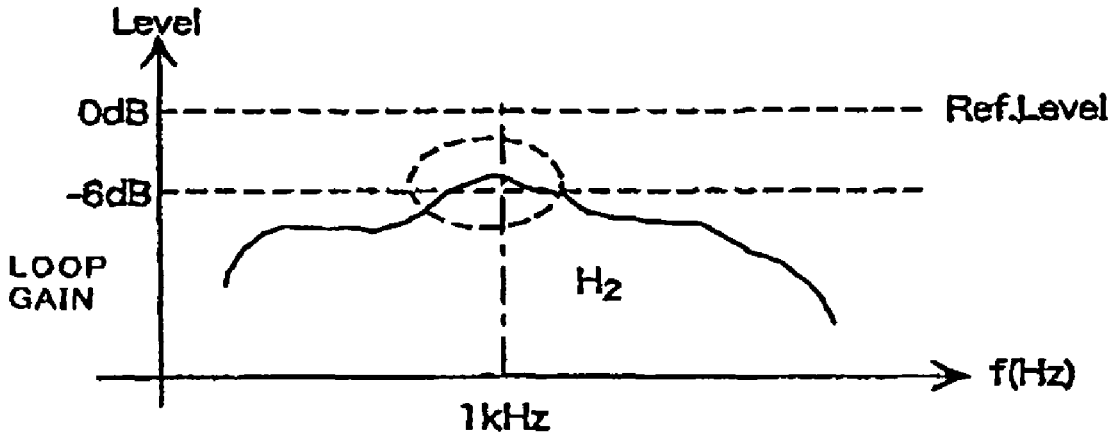
Figure 2D:
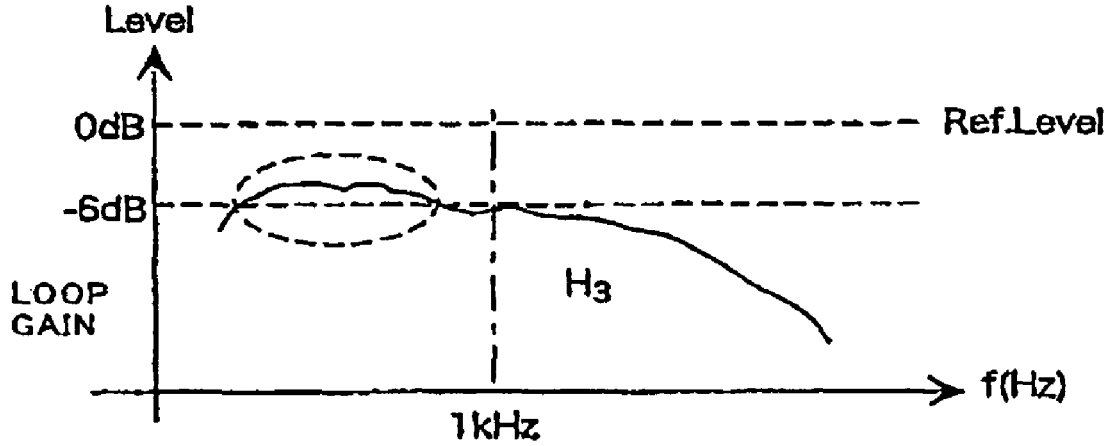

FIG. 2B to FIG. 2D are diagrams showing general example of the loop property when the microphones 35 are set at positions A, B and C which are different distance from the loudspeaker 34. A horizontal axis represents frequency, and a vertical axis represents the levels.

When the number of the loudspeakers to reproduce the reinforced sound in order to prevent generation of howling are N, the loop gain is set to be −6 dB in a case that the number of the loudspeakers is one.

$$\text{Loop Gain} = -10 \log N - 6$$

It is necessary to set the loop gain to a value derived from the above described equation.

Therefore, the amount of attenuation by the ATT 18 is set to be a value in consideration to the value of the loop gain.

FIG. 2B is a diagram showing an example of a loop property when a distance between the microphone 35 and the loudspeaker 34 is short. As described in the drawing, when the distance between the loudspeaker 34 and the source position is short, the level of the input signal from the microphone 34 is large, and howling at the high frequency range may generated because a peek is generated in the loop property in the high frequency range. Therefore, as described in the above, the amount of attenuation by the ATT 18 is set to be large, and the gain in the high frequency range is lowered by the equalizer 17. Therefore, the reinforcement gain can be raised for that by controlling the peek of the loop property in the high frequency range. That is, the level of the reinforced sound can be raised, and clarity of the sound can be improved. Moreover, coloration can be decreased and the quality of the reinforced sound can be improved by flattening the frequency response of the loop property.

FIG. 2C is a diagram showing an example of a loop property when a distance between the microphone 35 and the loudspeaker 34 is middle. When the distance between the loudspeaker 34 and the source position is middle, the level of the input signal from the microphone 34 is middle, and howling at the middle frequency range may generated because of generation of peek to the loop property in the middle frequency range. Therefore, the amount of attenuation by the ATT 18 is set to be middle, and the gain in the middle frequency range is lowered by the equalizer 17. Therefore, the reinforcement gain can be raised for that by controlling the peek of the loop property in the middle frequency range. That is, the level the reinforced sound can be raised, and clarity of the sound can be improved. Moreover, coloration can be decreased and the quality of the reinforced sound can be improved by flattening the frequency response of the loop property.

FIG. 2D is a diagram showing an example of a loop property when the distance between the microphone 35 and the loudspeaker 34 is long. When the distance between the loudspeaker 34 and the source position is long, the level of the input signal from the microphone 34 is low, and howling at the low frequency range may be generated because of generation of peek to the loop property in the low frequency range. Therefore, the amount of attenuation by the ATT 18 is set to be minimum, and the gain in the low frequency range is lowered by the equalizer 17. Therefore, the reinforcement gain can be raised for that by controlling the peek of the loop property in the low frequency range. That is, the level the reinforced sound can be raised, and clarity of the sound can be improved. Moreover, coloration can be decreased and the quality of the reinforced sound can be improved by flattening the frequency response of the loop property.

As described in the above, the controlling parameter to be provided to the equalizers $\mathbf{17}_o$-$\mathbf{17}_n$ and the ATT $\mathbf{18}_o$-$\mathbf{18}_n$ of the each output line is determined based on the measured result at each source position and at a time of the source position. Also, delay time to add the signal of each output line is determined corresponding to the source position and the distance from each loudspeaker $\mathbf{21}_o$-$\mathbf{21}_n$. Moreover, when loop property common to all of the output lines is compensated, the controlling parameter to be provided to the equalizer 15 is determined. Then, each source position determined as the above, delay time corresponding to that, the output levels and the controlling parameter of the equalizing property are stored in the storage device 24 as a table form.

As described before, when a new source position or movement of the source position is detected by the source position detector 23, a new controlling parameter corresponding to the equalizer 15, delay means $\mathbf{16}_o$-$\mathbf{16}_n$, equalizers $\mathbf{17}_o$-$\mathbf{17}_n$ and the ATT $\mathbf{18}_o$-$\mathbf{18}_n$ equipped in each output line is read out to be provided with reference to the table.

As doing that, the loop property by each line of each speaker $\mathbf{21}_o$-$\mathbf{21}_n$ can be optimized corresponding to change of the source position detected by the source position detector 23, and howling can be prevented, and the reinforced sound with high-quality can be executed.

Next, a second embodiment of the sound field controlling apparatus in the present invention that can improve quality of the reinforced sound is explained.

Figure 3:
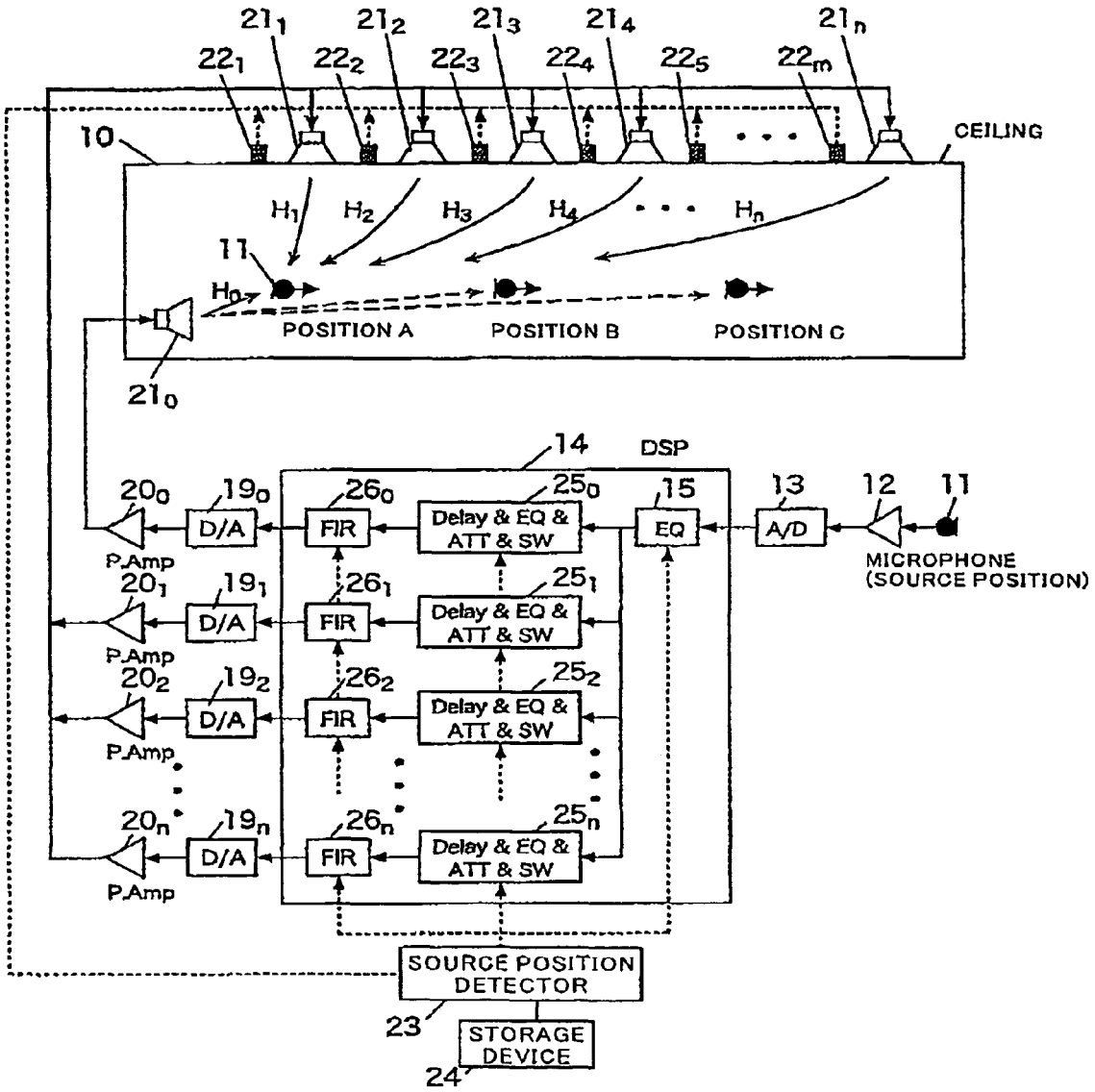
FIG. 3 is a block diagram showing a structure of a sound field controlling apparatus according to a second embodiment of the present invention.

FIG. 3 is a block diagram showing a structure of a sound field controlling apparatus according to the second embodiment of the present invention. In this drawing, explanations for the same components as FIG. 1 are omitted by referring than by the same reference numbers.

In FIG. 3, the numerals $\mathbf{25}_o$-$\mathbf{25}_n$ indicate delay means $\mathbf{16}_o$-$\mathbf{16}_n$, equalizers 17*o*-17*n*, the ATT $\mathbf{16}_o$-$\mathbf{18}_n$ in FIG. 1 and the switch all together (Delay, EQ, ATT and SW). In the sound field controlling apparatus according to the second embodiment, FIR (finite impulse response) filters $\mathbf{26}_o$-$\mathbf{26}_n$ controlled by the source position detector 23 are equipped in the output lines of each loudspeakers $\mathbf{21}_o$-$\mathbf{21}_n$ in addition to the first embodiment shown in FIG. 1. Quality of the reinforced sound can be improved by convolving a reflected sound by using this FIR filters $\mathbf{26}_o$-$\mathbf{26}_n$.

Figure 4A:
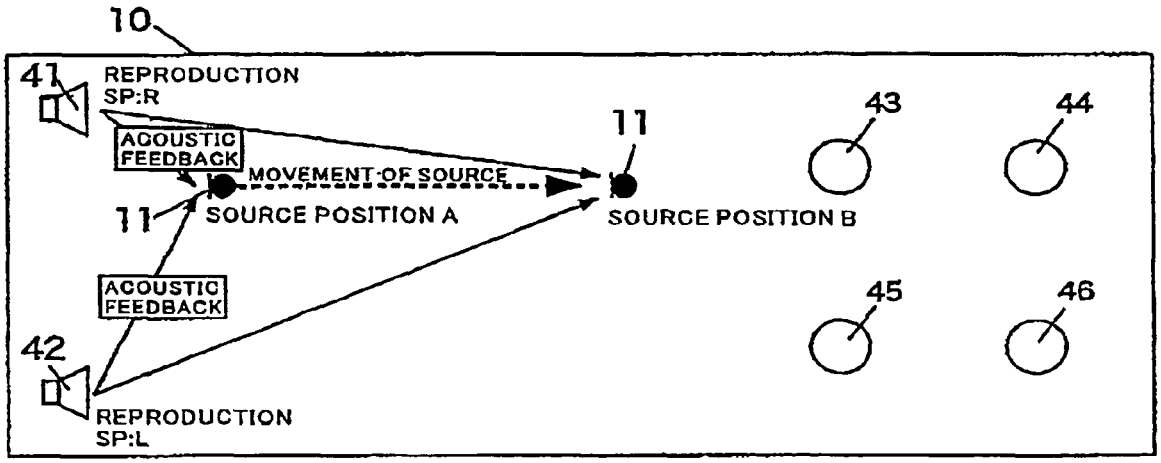
FIG. 4A to FIG. 4C are drawings for explaining convolution of a reflected sound.

The convolution of the reflected sound by using the FIR filter is explained with reference to FIG. 4. FIG. 4A is a plan view, from the ceiling of a meeting room 10 adopted the sound field controlling apparatus according to the second embodiment of the present invention. In this room, a loudspeaker 41 of an R channel and a loudspeaker 42 of L channel are positioned as reinforced sound loudspeaker at one side (front side) of the room 10. Plurality of the reinforced sound loudspeakers 43, 44, 45 and 46 are positioned dispersedly on the ceiling at the opposite side (backside) of the above-described loudspeakers 41 and 42. The above-described case are explained in the below.

Figure 4B:
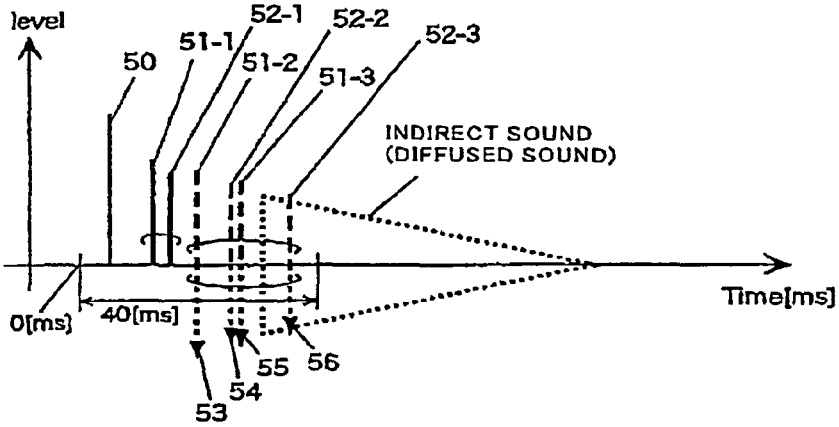
Figure 4C:
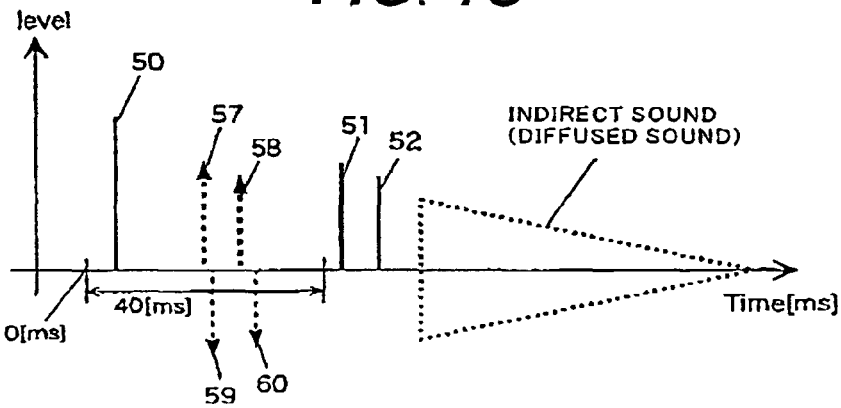
Figure 5:
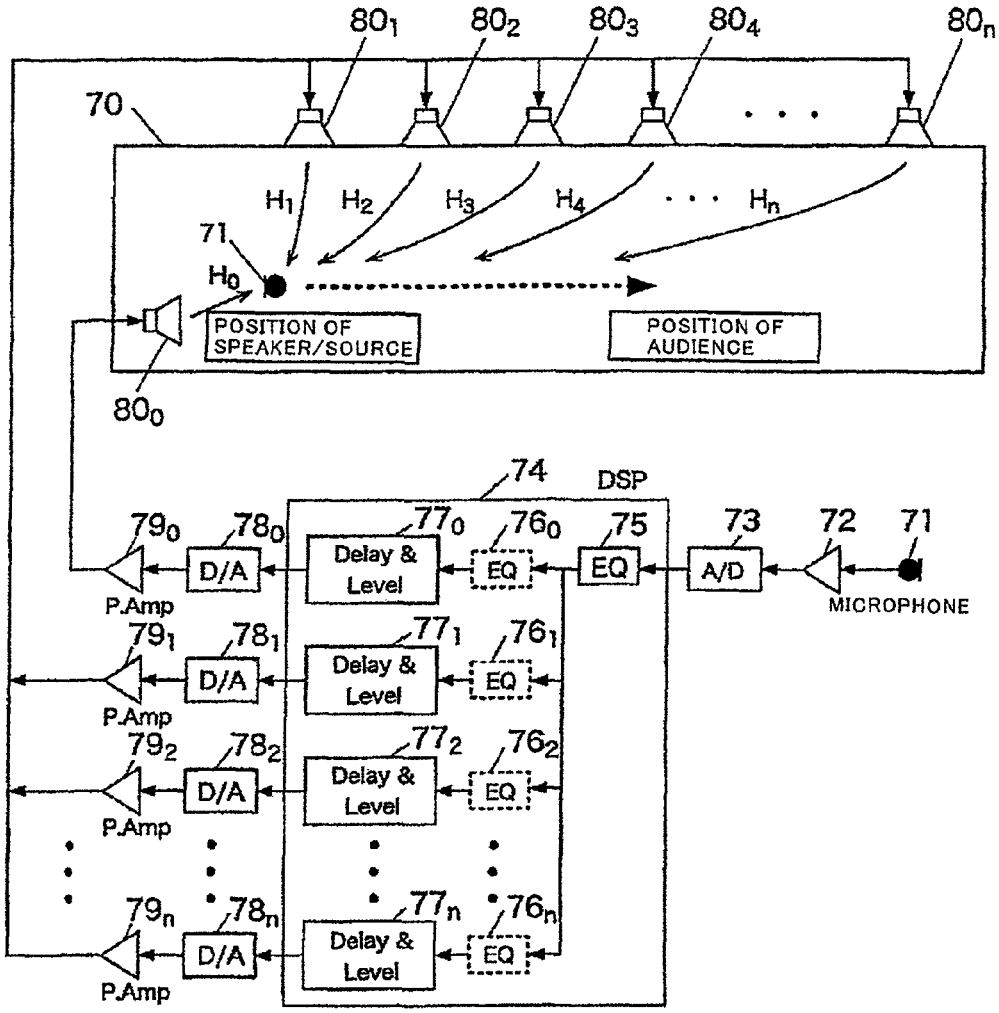
PRIOR ART FIG. 5
FIG. 5 is a diagram showing an example of a structure of a public-address system according to the prior art.

FIG. 4B is a diagram showing an example of a time structure of an input signal to a microphone 11 when a source position is close (position A) to the reinforced sound loudspeakers 41 and 42. FIG. 4C is a diagram showing an example of a time structure of an input signal to the microphone 11 when a source position is far (position B) from the reinforced sound loudspeakers 41 and 42.

In FIG. 4B, it is assumed that the speaker uttered at a timing of 0 ms. A reference number "50" is a direct sound uttered by the speaker to be input to the microphone 11, and reference numbers "51-1" to "51-3" are sound to be output from the loudspeaker 41 and to be input to the microphone 11 after executing the signal process of the direct sound input to the microphone 11 by the DSP 14. The "51-1" is the first sound of which the direct sound input to the microphone 11 is output from the R channel loudspeaker 41 to return to the microphone 11. The "51-2" is the sound of which the sound of the "51-1" is picked up by the microphone 11 to output from the R channel loudspeaker 41 to return to the microphone 11. As same as the "51-2", "51-3" is the sound of which the "51-2" is looped the same root. Moreover, the "52-1" to "52-3" are the sound looped and output through the L channel loudspeaker 42 to be input to the microphone 11.

As described in the above, a well-known comb-shaped filter is formed by being input the delayed signals by a fixed time from the signal to signal, and coloration is generated in the reinforced sound because a peek/dip on the frequency response is periodically appeared.

Also, generally, the reflected sound that reaches within a fixed time (40 msec) from the first reached sound is effective to clarity, and it is known that the reflected sound that reaches delayed for a fixed time (95 msec) or more than that is harmful. (Page 32-35, "Sound System Design" by The Bose Professional Sound Group, translated by Minoru Nagata, Ohmsha, 1991, the entire contents of which are incorporated herein by reference)

In the embodiment of the present invention, in the sounds output from the loudspeaker 41 and 42 and input to the microphone 11, the "51-1" and the "52-1" are just output without change because they contribute to clarity. Sounds 53, 54, 55, 56 and so on which are negative coefficients of the same amplitude and the same timing are convolved by the FIR filters $\mathbf{26}_o$-$\mathbf{26}_n$ to each component of the "51-2", "51-3", "52-2", "52-3" and so on which are output by looping and form the comb-shaped filters. Clarity of the reinforced sound can be maintained by outputting the components of the "51-1" and the "52-1". Moreover, the frequency response can be flattened by convolving the "53", "54", "55", "56", etc. and coloration by forming of the comb-shaped filter can be relieved to improve quality of the reinforced sound.

In detail, to the signals output from the loudspeakers 41 and 42, the negative coefficient sounds "53", "54", "55", "56", etc. are convolved in the sounds "51-2", "51-3", "52-2", "52-3" of the input signals from the microphone by using the FIR filter 26*i* and 26*j* equipped to each output line at the same timing for "51-2", "51-3", "52-2", "52-3", etc.

By doing that, high level of clarity of the reinforced sound output from each one of the loudspeakers 41 to 46 can be maintained by outputting the components (51-1 and 52-1) contributing to the clarity of the reinforced sound and can be a high quality by controlling coloration.

FIG. 4C is a diagram showing an example of a time structure of an input signal to the microphone 11 when a source position (position of the microphone 11) is far (position B) from loudspeakers 41 and 42. As described in the diagram, when a source position is far from the loudspeakers 41 and 42, the sound 51 and 52 output from the loudspeakers 41 and 42 reach to the microphone 11 largely delaying from direct sound 50 uttered by the speaker at 0 ms timing and to be input to the microphone 11. Therefore, the reflected sound contributing to clarity does not exist near (within 40 msec) the direct sound 50.

In this case, the reflected sounds 57, 58, 59 and 60 are convolved within a fixed time (for example, 40 msec) from the timing of the direct sound by using the corresponding FIR filters 26*k*-26*l*. That is, the reflected sound contributing to clarity can be included in the reinforced sound output from the loudspeakers 43 to 46 by controlling a fixed delay time, equalizing property and levels to the input signal to the microphone 11. Moreover, the convolved sounds 59 and 60 are changed to be the negative coefficient sounds by slightly changing timings and amplitudes in order not to have unnecessary strong influence of the reflected sounds 57 and 58, and coloration by flattening the frequency response and forming the comb-shaped filter can be relieved. Although in the embodiment, the number of the convolved sounds is four, it is not limited to that number.

By doing that, a direct sound ratio car; be improved to obtain high clarity, and high quality of the reinforced sound of which coloration is controlled can be realized.

As same as the above, information relating to the reflecting sound convolved to the tap of the FIR filters $\mathbf{26}_o$-$\mathbf{26}_n$ of each output line is determined to store information (information about a convolution property (convolution data) of the reflected sound) to the before-described table in order to execute convolution by the FIR filter $26_o$-$26_n$ shown in FIG. 4B and FIG. 4C. When a new source position or the movement of the source position is detected by the source position detector 23, reinforcement that is easy to hear by the audience and is easy to speak by the speaker can be executed by convolving the reflected sound corresponding to the detected source position with reference to the table.

Although the embodiment of the present invention has been explained focusing on a voice or a voice signal, the present invention can be applied to process any types of sounds or sound signals such as a musical tone, etc.

The present invention has been described in connection with the preferred embodiments. The invention is not limited only to the above embodiments. It is apparent that various modifications, improvements, combinations, and the like can be made by those skilled in the art.

What is claimed is:

1. A sound field controlling apparatus for a public address system, the sound field controlling apparatus comprising:

a plurality of microphones that inputs a sound signal corresponding to a sound of a sound source;

at least one loudspeaker that outputs the sound signal input by one of the microphones;

a sound source position detector that detects a position of the sound source and selects at least one of said microphones as an address microphone based on the detected position of the sound source;

a signal processor that processes the sound signal input by the address microphone and comprises, corresponding to each output line of each of said at least one loudspeaker, a delay device, an equalizer and a volume controlling attenuator, wherein the delay device adds a delay time corresponding to a distance between the position of the sound source and the corresponding loudspeaker to the input sound signal for making a sound output by the corresponding loudspeaker reach a listener within a predetermined time from a direct sound of the sound source, and the equalizer and attenuator control an equalizing property and an output level of the input sound signal for flattening a frequency response of sound feedback between the corresponding loudspeaker and the address microphone, wherein the signal processor further comprises, corresponding to each output line of each of said at least one loudspeaker, a finite impulse response (FIR) filter that convolves a negative coefficient of a same amplitude and a same timing to each of signals corresponding to sounds repeatedly output from the corresponding loudspeaker and input to the address microphone except a signal corresponding to a first sound output from the corresponding loudspeaker in order to flatten a frequency response of sound feedback between the corresponding loudspeaker and the address microphone.

2. The sound field controlling apparatus according to claim 1, further comprising a storage device that stores, for each position of the sound source determined by sound feedback amount between said at least one loudspeaker and the plurality of microphones whose distances from said at least one loudspeaker are different from each other, control parameters for controlling the delay device, the equalizer and the attenuator, and wherein the sound source position detector supplies the control parameters for controlling the delay device, the equalizer and the attenuator corresponding to the detected position of the sound source with reference to the storage device to the signal processor.

3. The sound field controlling apparatus according to claim 1, further comprising a second storage device that stores information relating to a reflecting sound convolved to a tap of the FIR filter of each output line for each position of the sound source, and wherein the sound source position detector supplies the information corresponding to the detected position of the sound source with reference to the second storage device to the FIR filter.

* * * * *